US005329073A

United States Patent [19]

Shono et al.

[11] Patent Number: 5,329,073

[45] Date of Patent: Jul. 12, 1994

[54] SOUND ABSORBING DEVICE FOR SOUND INSULATION WALL

[75] Inventors: Yutaka Shono, Tokyo; Masahito Watanabe, Hyogo; Kohei Yamamoto; Naoyuki Furuta, both of Tokyo, all of Japan

[73] Assignee: Nitto Boseki Co., Ltd., Fukushima, Japan

[21] Appl. No.: 89,529

[22] Filed: Jul. 21, 1993

[30] Foreign Application Priority Data

Feb. 9, 1993 [JP] Japan ..... 5-044512

[51] Int. Cl.[5] ..... G10K 11/00

[52] U.S. Cl. ..... 181/210; 181/284; 181/290

[58] Field of Search ..... 181/210, 284, 285, 286, 181/290, 294, 295, 293; 52/144

[56] References Cited

U.S. PATENT DOCUMENTS 4,899,846 2/1990 Furuta et al. ..... 181/210

FOREIGN PATENT DOCUMENTS 3919280 12/1989 Fed. Rep. of Germany ..... 181/210
51-46969 12/1976 Japan .
62-186200 11/1987 Japan .

*Primary Examiner*—Michael L. Gellner
*Assistant Examiner*—Khanh Dang
*Attorney, Agent, or Firm*—Sixbey, Friedman, Leedom & Ferguson

[57] ABSTRACT

A sound absorbing material is interposed between an outer perforated plate and an inner plate to constitute a sound absorbing body, which has a bottom wall portion extending generally vertically, a hood portion laterally bulging from the top of the bottom wall portion to assume a semi-circular cross-section, and a top wall portion extending from the hood portion to assume a gentle convex cross-section. A cap is attached to the end face of the top wall portion, and a fixing member is attached to a lower portion of the bottom wall portion to constitute a sound absorbing device. The two sound absorbing devices having the identical structure are fixed to the outer surfaces of an upper portion of an upright sound insulation wall through the fixing members so as to assume a symmetrical fixing posture. The caps of the two sound absorbing devices are connected by a connecting member. Alternatively, a gap is formed between the caps and a space suitable for planting is defined by a top surface of the sound insulation wall and the two inner plates.

9 Claims, 7 Drawing Sheets

SOUND ABSORBING DEVICE FOR SOUND INSULATION WALL

BACKGROUND OF THE INVENTION

The present invention relates to a sound absorbing device to be mounted on a sound insulation wall which is installed, for instance, by the side of an expressway to insulate noise caused by passage of vehicles.

For example, Japanese Patent Application Examined Publication No. Sho. 51-46969 and Japanese Utility Model Application Unexamined Publication No. Sho. 62-186200 disclose mounting a sound absorbing device on top of a sound insulation wall which is installed, for instance, by the side of an expressway. However, these conventional sound absorbing devices have the following disadvantages. First, to fix a long cylindrical sound absorbing device having a relatively large diameter to the top of an upright sound insulation wall, tightening bands for the sound absorbing device and metal fixing parts therefor need to be separately provided on top of the sound insulation wall. To prevent drop of the sound absorbing device, wires need to be used so as to penetrate through the sound absorbing device in its radial direction and to be fixed to the wall. Further, the size of the fixing metal parts for the sound absorbing device needs to be adjusted for that of the sound insulation wall. Therefore, a complicated work is needed to install the sound absorbing device with the use of a large number of parts.

Further, the appearance is very poor because the cylindrical sound absorbing device is provided on top of the upright sound insulation wall, the former is fixed to the latter with the bands at intervals of several meters, and the band fixing parts protrude sideways.

An additional work of filling the space between the flat top surface of the upright sound insulation wall and the cylindrical sound absorbing device makes the fixing operation unduly longer.

SUMMARY OF THE INVENTION

An object of the present invention is to provide a sound absorbing device which can easily be fixed to various sound insulation walls having different thicknesses even if it has a single type of structure, which has a good appearance, which enables planting in a space enclosed by the two sound absorbing devices, and which exhibits superior sound absorbing characteristics.

Another object of the invention is to providing a sound insulation wall assembly using the above sound absorbing devices.

According to a first aspect of the invention, a sound absorbing device for a sound insulation wall comprises:

a sound absorbing body having a large longitudinal dimension, comprising an outer perforated plate, an inner plate, and a sound absorbing material interposed between the outer perforated plate and the inner plate, and comprising continuous portions of a bottom wall portion extending generally vertically, a hood portion laterally bulging from a top of the bottom wall portion to assume a generally semi-circular cross-section, and a top wall portion extending from the hood portion crossing a plane of the inner plate of the bottom wall portion to assume a gentle convex cross-section;

a fixing member provided on a lower portion of the bottom wall portion, for fixation to a sound insulation wall; and a cap for closing an end face of the top wall portion.

According to a second aspect of the invention, a sound insulation wall assembly comprises:

a sound insulation wall; and a pair of sound absorbing devices having an identical structure, each comprising:

a sound absorbing body having a large longitudinal dimension, comprising an outer perforated plate, an inner plate, and a sound absorbing material interposed between the outer perforated plate and the inner plate, and comprising continuous portions of a bottom wall portion extending generally vertically, a hood portion laterally bulging from a top of the bottom wall portion to assume a generally semi-circular cross-section, and a top wall portion extending from the hood portion crossing a plane of the inner plate of the bottom wall portion to assume a gentle convex cross-section;

a fixing member provided on a lower portion of the bottom wall portion; and a cap for closing an end face of the top wall portion;

wherein the pair of sound absorbing devices are fixed to an upper portion of the sound insulation wall through the respective fixing members so as to assume a symmetrical fixing posture.

The caps of the pair of sound absorbing devices are connected by a connecting member. Alternatively, a gap is formed between the caps and a space suitable for planting is defined by a top surface of the sound insulation wall and the two inner plates.

DESCRIPTION OF THE PREFERRED EMBODIMENTS

Figure 1:
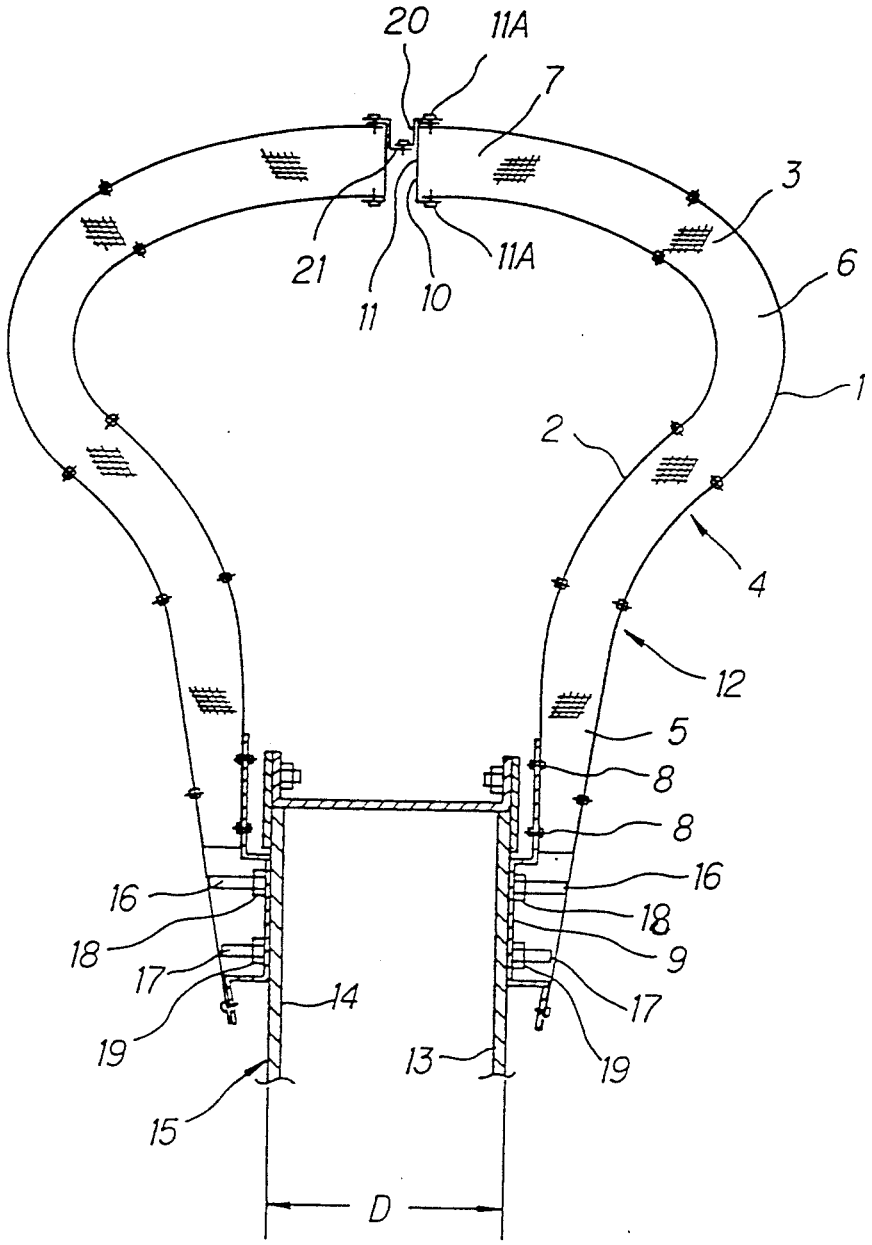
FIG. 1 is a vertical sectional view of a sound insulation wall assembly according to a first embodiment of the present invention.
Figure 2:
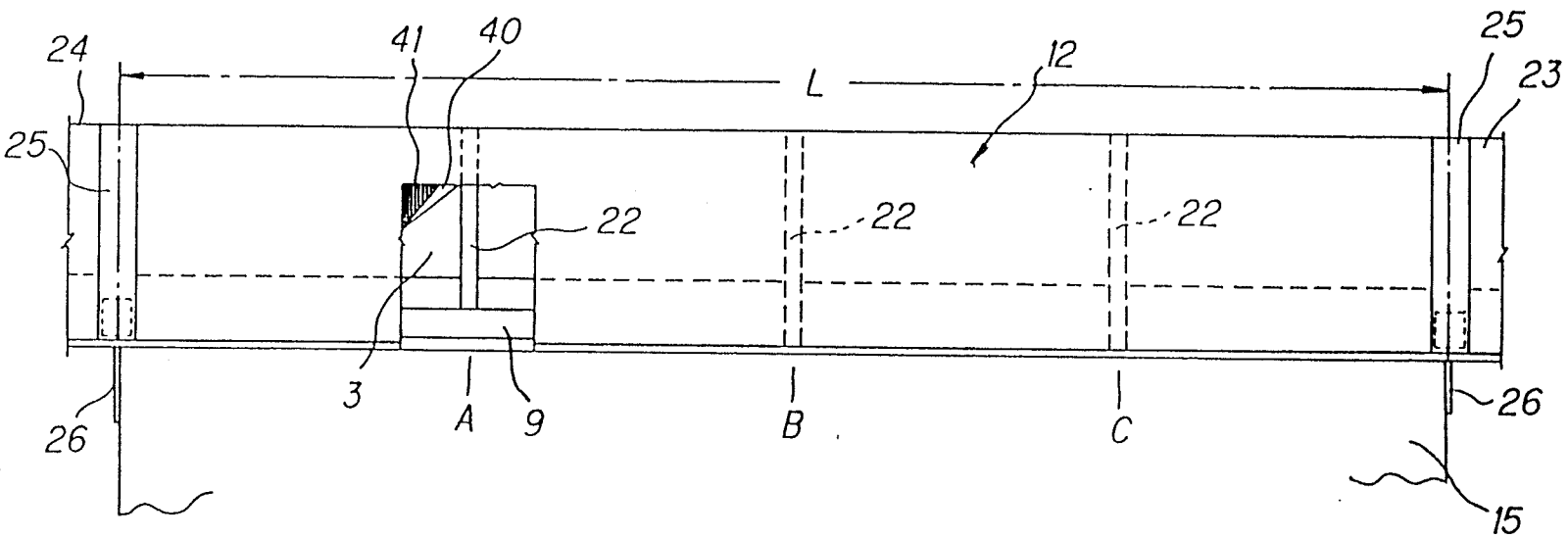
FIG. 2 is a side view of the sound absorbing wall assembly of FIG. 1.

FIGS. 1 and 2 show a first embodiment of the present invention. A sound absorbing body 4 mainly consists of a perforated plate 1 such as a perforated aluminum plate, an inner plate 2 such as a galvanized steel plate, and a sound absorbing material 3 interposed between the outer and inner plates 1 and 2 and made of, for instance, an inorganic fiber (e.g., glass fiber) mat, organic fiber mat, metallic fiber mat, porous ceramic sound absorbing material, or sintered alloy sound absorbing material.

The sound absorbing body 4 has a large longitudinal dimension, and is constituted of a vertically extending bottom wall portion 5, a hood portion 6 laterally bulging from the top of the bottom wall portion 5 so as to assume a generally semi-circular cross-section, and a top wall portion 7 extending the hood portion 6 in the direction opposite to the bulging direction of the hood portion 6 crossing the plane of the inner plate 2 of the bottom wall portion 5 so as to assume a gentle convex cross-section.

A bracket-like fixing member 9 is fixed, with screws 8 or the like, to the lower portion of the inner plate 2 of the bottom wall potion 5. A cap 11 is fixed to an end face 10 of the top wall portion 7 with screws 11A. Thus, a sound absorbing device 12 for a sound insulation wall is formed.

Bolts 16 and 17 are fixed, by arc stud welding or the like, to both outer surfaces of the upper portion of a sound insulation wall 15 constituted of metal plates 13 and 14. The two sound absorbing devices 12 are attached to the upper portion of the sound insulation wall 15 through the bracket-like fixing member 9 by engaging nuts 18 and 19 with the bolts 16 and 17.

As shown in FIG. 1, the end faces 10 of the top wall portions 7 of the two sound absorbing devices 12 that are fixed to the respective outer surfaces of the upper portion of the sound insulation wall 15 are rendered into an opposed state, and the caps 11 are connected to each other with connecting members 20 and 21. Thus, the two sound absorbing devices 12 are connected and fixed to each other.

As shown in FIG. 2, in the sound absorbing device 12 having a large longitudinal dimension, reinforcement members 22 are provided between the perforated plate 1 and the inner plate 2 and united with the fixing member 9 at locations to divide a single unit having a total length L into a plurality of sections (in this embodiment, at locations A, B and C to divide it into four sections). The unit sound absorbing device 12 is connected to adjacent unit sound absorbing devices 23 and 24 with connecting plates 25, which are fixed to the sound insulation wall 15 with brackets 26.

As is apparent from FIG. 1, the right and left sound absorbing devices 12 are symmetrical. Therefore, it suffices to produce the sound absorbing devices 12 of the single type of structure. The sound insulation wall 15 having the sound absorbing devices 12 can be constructed by fixing, in a symmetrical way, the sound absorbing devices 12 to the respective outer surfaces of the upper portion of the sound insulation wall 15.

If each sound absorbing device 12 is prepared so that the top wall portion 7 elongates excessively, it becomes possible to use the sound absorbing devices 12 of the single structure for various upright sound insulation walls 15 having different thicknesses by cutting off the unnecessary part of the top wall portion 7 in accordance with the thickness D of the sound insulation wall 15 actually used.

In the embodiment of FIGS. 1 and 2, the fixing member 9 provided on the inner surface of the lower wall portion 5 of the sound absorbing device 12 is connected and fixed to the outer surface of the upper portion of the sound insulation wall 15. However, the fixing positions and fixing structures of the sound absorbing device 12 and the sound insulation wall 15 are not limited to those shown in FIGS. 1 and 2, but any fixing positions and structures may be employed as long as the sound absorbing device 12 and the sound insulation wall 15 can be fixed to each other firmly in a relatively easy manner.

As shown in the partial broken part of FIG. 2, for the protection purpose the sound absorbing material 3 of the sound absorbing device 12 is covered with a polyvinyl chloride film 40, which is covered with a glass cloth 41. But it is noted that the protection structure of the sound absorbing material 3 is not limited to this one.

Figure 3:
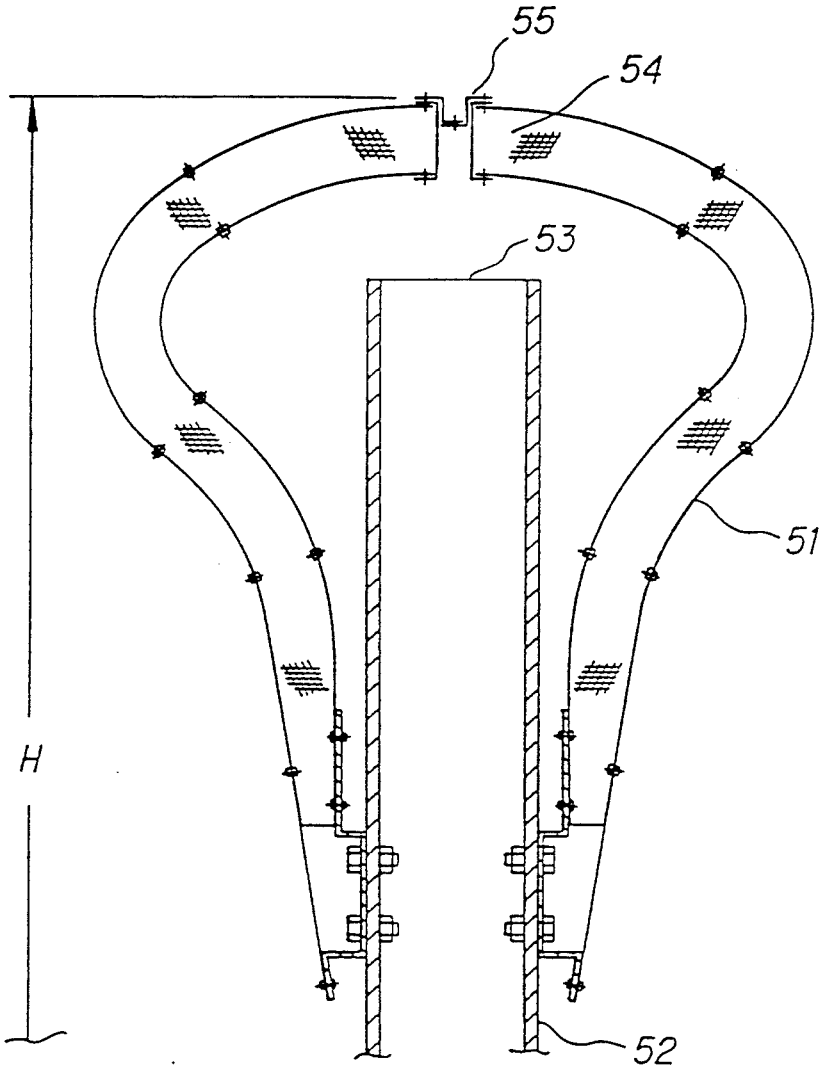
FIG. 3 is a vertical sectional view of a sound insulation wall assembly according to a second embodiment of the invention.

FIG. 3 shows a second embodiment of the invention. In this embodiment, sound absorbing devices 51 having the same structure as the sound absorbing device 12 of the first embodiment are fixed to a sound insulation wall 52 (already installed) at a position a certain distance below a top end face 53 so that the top 55 of a top wall portion 54 of the sound absorbing device 51 is located within an allowable range of a height limitation H of the sound insulation wall 51.

Figure 4:
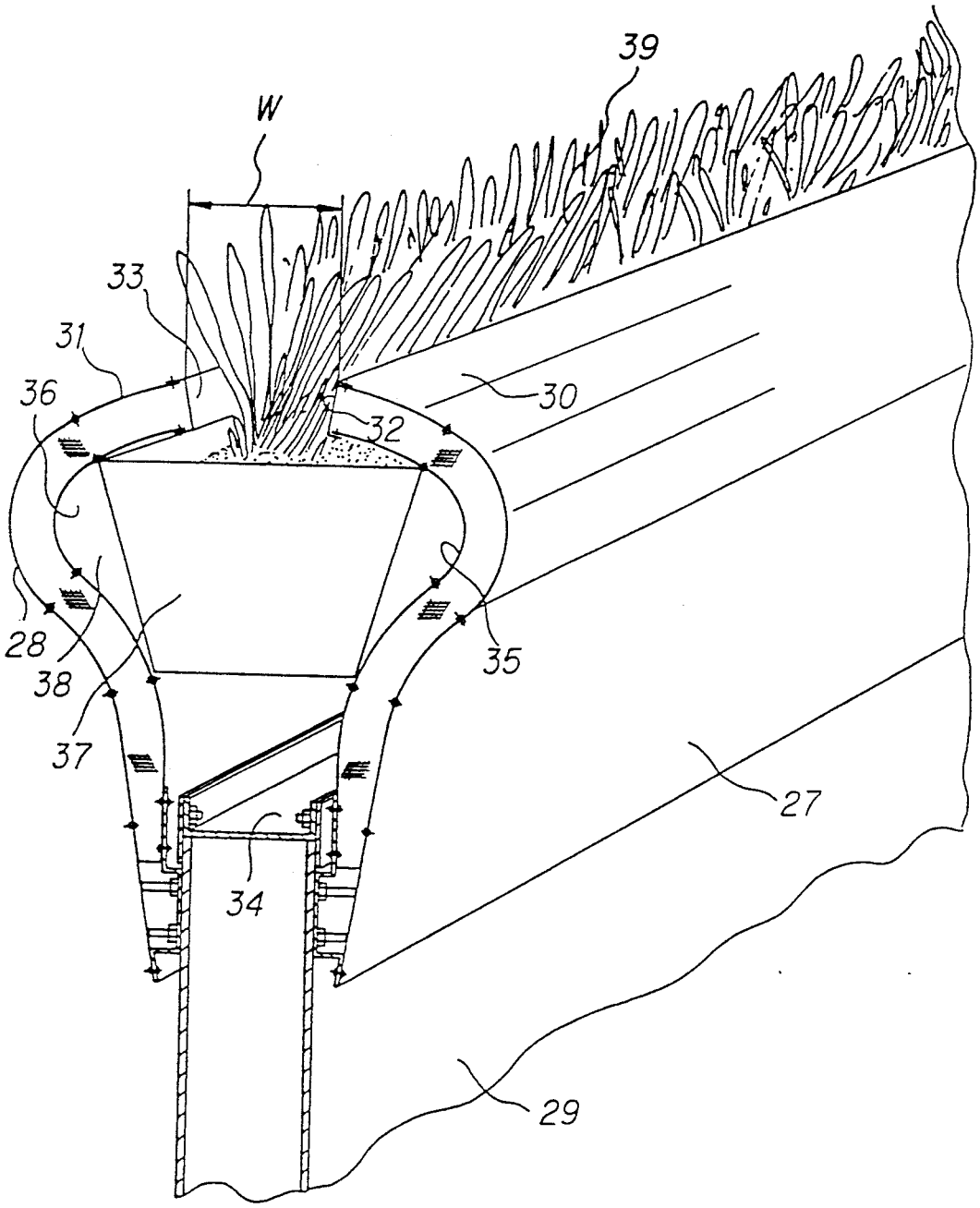
FIG. 4 is a perspective view of a sound insulation wall assembly according to a third embodiment of the invention.

FIG. 4 shows a third embodiment of the invention. In this embodiment, sound absorbing devices 27 and 28 having the same structure as the sound absorbing device 12 of FIGS. 1 and 2 are fixed to the outer surfaces of the upper portion of a sound insulation wall 29. End faces of top wall portions 30 and 31 of the sound absorbing devices 27 and 28 closed by respective caps 32 and 33 are faced with each other with a gap W.

A space 38 is defined as a portion enclosed by a top surface 34 of the sound insulation wall 29 and inner surfaces 35 and 36 of the right and left sound absorbing devices 27 and 28.

The gap W serves such that plants 39 in a planter 37 that is disposed in the space 38 can grow through the gap W, and that rain water etc. can be introduced to the planter 37 through the gap W. The planting may be performed without using the planter 37, i.e., by directly introducing soil into the space 38. The planting is not essential in the invention.

Figure 5:
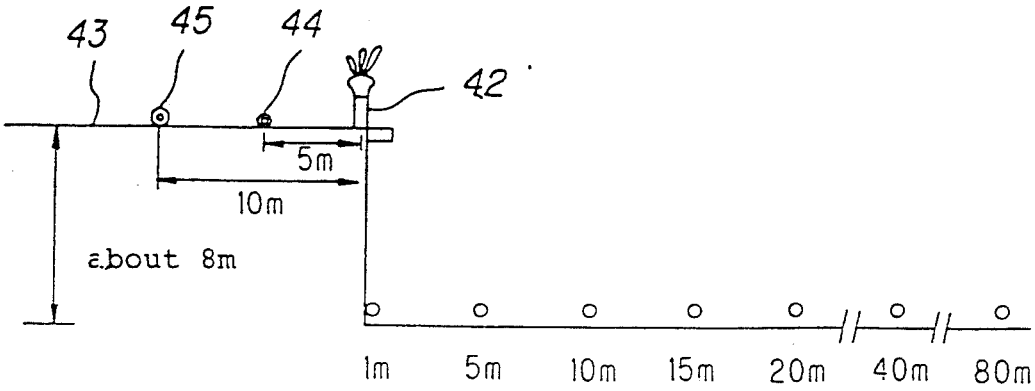
FIG. 5 shows conditions of an experiment which was conducted to compare the sound insulation characteristics of various sound insulation wall assemblies.
Figure 6:
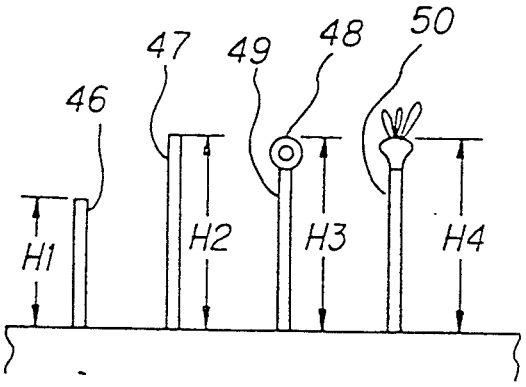
FIG. 6 shows the sound insulation wall assemblies which were subjected to the experiment.

An experiment was made under the conditions of FIG. 5 to compare the sound insulation characteristics of the sound insulation wall having the sound absorbing devices 27 and 28 (third embodiment) with that of the conventional sound insulation walls (see FIG. 6). Results are shown in FIGS. 7–9.

That is, as shown in FIG. 5, a sound insulation wall (assembly) 42 was erected at the shoulder of an elevated two-lane road (actually a construction so regarded) having a height of about 8 m, and speakers 44 and 45 were placed at the center (spaced 5 m from the sound insulation wall 42) of one lane and at the center (spaced 10 m from the sound insulation wall 42) of the other lane. Each of the speakers 44 and 45 emitted sound representing noise as would be caused by running vehicles under the maximum traffic condition.

Noise detectors were arranged at a height of 1.2 m and at locations spaced 1 m, 5 m, 10 m, 15 m, 20 m, 40 m and 80 m, respectively from the bottom of the sound insulation wall (assembly) 42. The following sound insulation walls (wall assemblies) were subjected to the measurement as the sound insulation wall 42 (see FIG. 6): an upright steel sound insulation wall 46 having a height H1 of 1 m, an upright steel sound insulation wall 47 having a height H2 of 1.5 m, a sound insulation wall assembly 49 having a height H3 of 1.5 m and consisting of an upright steel sound insulation wall and a hollow-cylinder sound absorbing device 48 mounted on top of the wall, and a sound insulation wall assembly 50 with plants according to the third embodiment and having a height H4 of 1.5 m.

Figure 7:
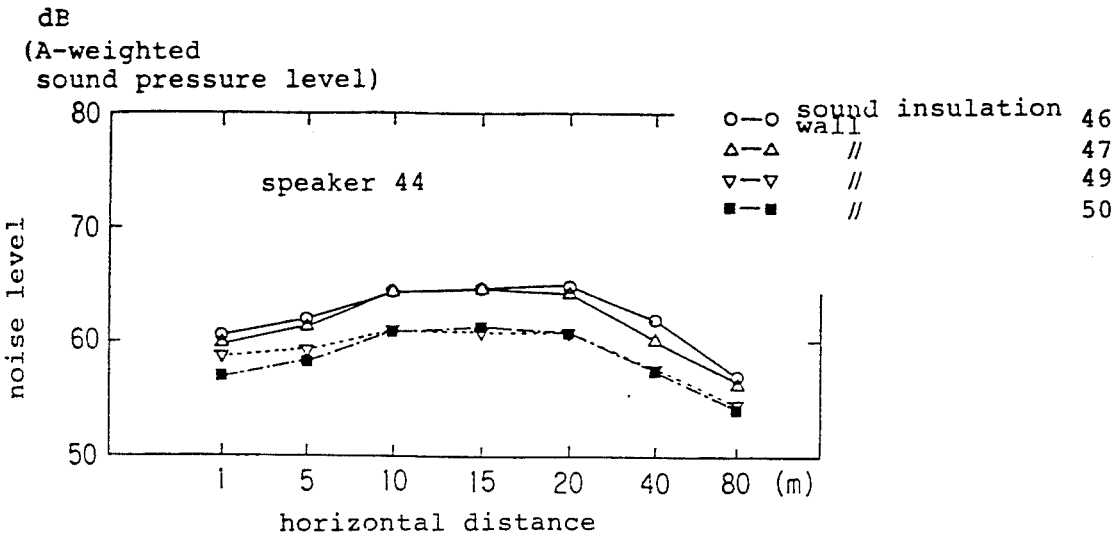
FIGS. 7–9 are graphs showing measurement results of the experiment.
Figure 8:
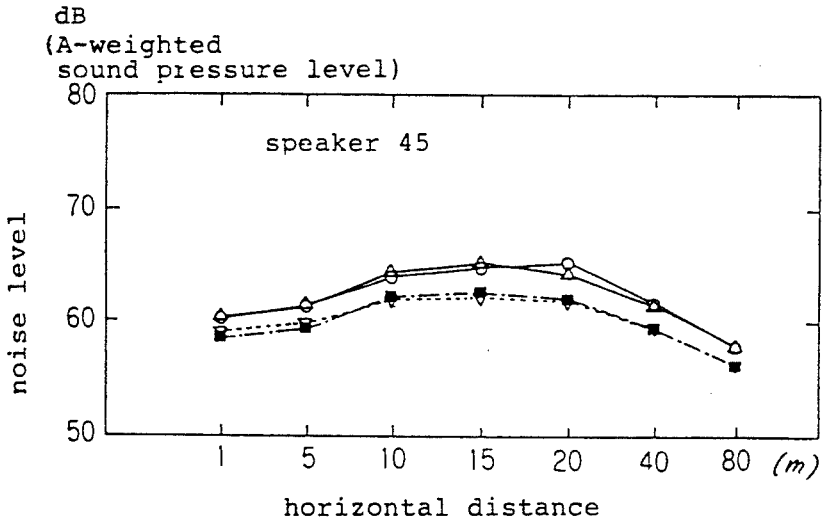
Figure 9:
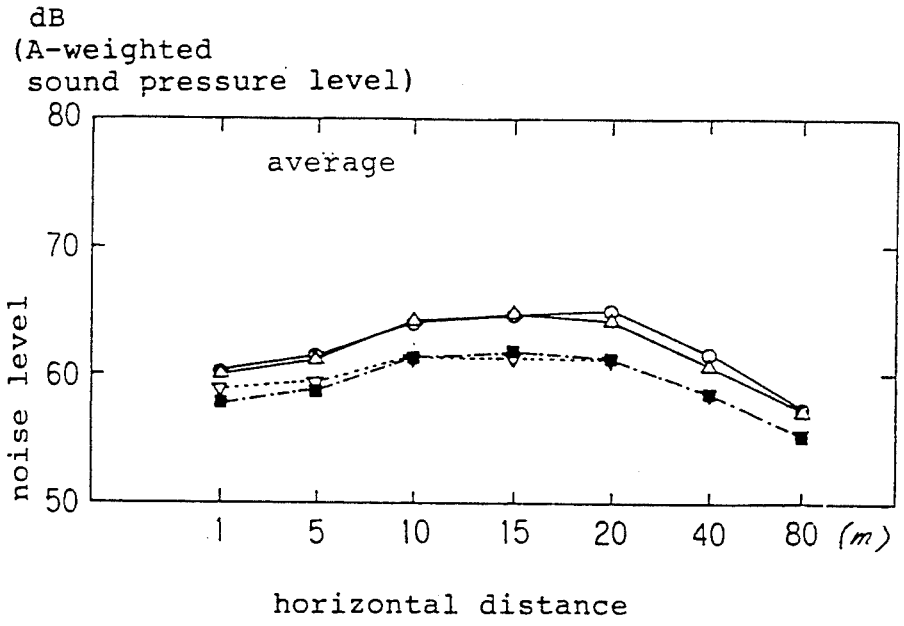

Measurement results are shown in FIG. 7 (for the speaker 44), FIG. 8 (for the speaker 45) and FIG. 9 (average thereof). It is understood that the sound insulation wall assembly of the third embodiment can provide a sound attenuation effect of about 3 dB (A-weighted sound pressure level) on average. The same sound attenuation effect was found with the sound insulation wall assembly of the first embodiment.

According to the invention, it suffices to prepare sound absorbing devices of the single type of structure. The sound absorbing devices can be attached to the respective sides of the sound insulation wall to assume a symmetrical fixing posture. Further, if the top wall portion is made excessively long, the sound absorbing devices can be fixed correctly to various sound insulation walls having different thicknesses simply by cutting off the unnecessary part of the top wall portion, which contributes to cost reduction of the sound absorbing device.

The sound absorbing device can be fixed to the existing sound insulation wall by a simple structure including bolts etc. arc-stud-welded to the sound insulation wall and the corresponding fixing member provided at the lower end portion of the sound absorbing device, which simplifies the fixing structure and facilitates the fixing operation.

Since the sound absorbing device consists of the bottom wall portion capable of being connected to the upper portion of the sound insulation wall to assume a smooth shape, the hood portion bulging to assume a semi-circular cross-section and continuous with the bottom wall portion, and the top wall portion having a gentle convex cross-section and continuous with the hood portion, it well matches, in design, the upright sound insulation wall. Further, the unnecessariness of fixing bands etc. improves its appearance.

Since the perforated plate constitutes the outer surface of the sound absorbing device and the sound absorbing device includes the hood portion bulging to assume a semi-circular cross-section and the top wall portion having a gentle convex cross-section and continuous with the hood portion, the sound absorbing device can effectively absorb and eliminate a noise component diffracted to pass over the top of the sound insulation wall, to prevent the diffraction of noise.

Specifically the third embodiment enables planting for the sound insulation walls without lowering the sound insulation and absorption characteristics.

What is claimed is:

1. A sound absorbing device for a sound insulation wall, comprising:

a sound absorbing body having a large longitudinal dimension, comprising an outer perforated plate, an inner plate, and a sound absorbing material interposed between the outer perforated plate and the inner plate, and comprising continuous portions of a bottom wall portion extending generally vertically, a hood portion laterally bulging from a top of the bottom wall portion to assume a generally semi-circular cross-section, and a top wall portion extending from the hood portion crossing a plane of the inner plate of the bottom wall portion to assume a gentle convex cross-section;

a fixing member provided on a lower portion of the bottom wall portion, for fixation to a sound insulation wall; and a cap for closing an end face of the top wall portion.

2. The sound absorbing device of claim 1, wherein the outer perforated plate is a perforated aluminum plate.

3. The sound absorbing device of claim 1, wherein the inner plate is a galvanized steel plate.

4. A sound insulation wall assembly comprising:

a sound insulation wall; and a pair of sound absorbing devices having an identical structure, each comprising:

a sound absorbing body having a large longitudinal dimension, comprising an outer perforated plate, an inner plate, and a sound absorbing material interposed between the outer perforated plate and the inner plate, and comprising continuous portions of a bottom wall portion extending generally vertically, a hood portion laterally bulging from a top of the bottom wall portion to assume a generally semi-circular cross-section, and a top wall portion extending from the hood portion crossing a plane of the inner plate of the bottom wall portion to assume a gentle convex cross-section;

a fixing member provided on a lower portion of the bottom wall portion; and a cap for closing an end face of the top wall portion;

wherein the pair of sound absorbing devices are fixed to an upper portion of the sound insulation wall through the respective fixing members so as to assume a symmetrical fixing posture.

5. The sound insulation wall assembly of claim 4, further comprising a member for connecting the caps.

6. The sound insulation wall assembly of claim 4, wherein the pair of sound absorbing devices are fixed to respective outer surfaces of the upper portion of the sound insulation wall.

7. The sound insulation wall assembly of claim 4, wherein a gap is formed between the caps and a space is defined by a top surface of the sound insulation wall and the inner plates.

8. The sound insulation wall assembly of claim 7, further comprising plants planted in the space, the plants being capable of growing through the gap.

9. The sound insulation wall assembly of claim 8, further comprising a planter for the plants provided in the space.

* * * * *